US007175125B2

(12) United States Patent
Redaelli

(10) Patent No.: US 7,175,125 B2
(45) Date of Patent: Feb. 13, 2007

(54) TAKE-UP APPARATUS FOR WINDING MACHINE

(75) Inventor: Luigi Redaelli, Milan (IT)

(73) Assignee: Wardwell Braiding Machine Co., Central Falls, RI (US)

( * ) Notice: Subject to any disclaimer, the term of this patent is extended or adjusted under 35 U.S.C. 154(b) by 0 days.

(21) Appl. No.: 10/842,330

(22) Filed: May 10, 2004

(65) Prior Publication Data

US 2005/0103919 A1 May 19, 2005

(30) Foreign Application Priority Data

May 9, 2003 (IT) ..... MI2003A0938

(51) Int. Cl.
*B65H 54/22* (2006.01)

(52) U.S. Cl. ..... 242/474.7; 242/476.6

(58) Field of Classification Search ..... 242/476.5, 242/476.6, 473.8, 474.7, FOR. 111
See application file for complete search history.

(56) References Cited

U.S. PATENT DOCUMENTS 3,592,399 A * 7/1971 Woodrow ..... 242/476.6
3,833,184 A 9/1974 Hara et al.
4,181,267 A * 1/1980 Schmitz-Steger ..... 242/476.6
4,695,010 A 9/1987 Smith
6,601,793 B2 * 8/2003 Yasui et al. ..... 242/472.8
2003/0029214 A1 2/2003 Steudle et al.

* cited by examiner

*Primary Examiner*—Kathy Matecki
*Assistant Examiner*—William E. Dondero

(57) ABSTRACT

A winding machine has a pay-off unit for unwinding a single- or multiple-end type wire material, a feed bobbin and a take-up unit for rewinding the wire material onto one or more bobbins. The pay-off unit is associated with a wire guide device having a motorized carriage, which can slide along the axis of motion and has an arm which rotates with respect to the carriage and is equipped with an idler wheel onto which the material unwound from the feed bobbin is wound. An angular position sensor detects the inclination of the arm with respect to the carriage and a control unit governs the carriage movements as a function of the signals provided by the sensor. The winding unit features at least one take-up device with a gripper to grasp an end of the wire material and actuators to reduce the gripping force of the gripper during winding.

20 Claims, 4 Drawing Sheets

TAKE-UP APPARATUS FOR WINDING MACHINE

RELATED APPLICATIONS

This application claims priority under 35 U.S.C. 119(a)–(d) to foreign patent application number MI2003A 000938, filed in Italy on May 9, 2003.

FIELD OF THE INVENTION

This invention concerns winding machines and, in particular, a winding machine with a pay-off unit for unwinding a single- or multiple-end wire material from a feed bobbin and a winding unit for rewinding the wire material onto one or more bobbins.

BACKGROUND

As is known, winding machines divide wire material coming from a feed bobbin, which is generally large-sized, onto smaller bobbins, which are then used in subsequent manufacturing processes. In the pay-off unit, the wire is unwound from the feed bobbin by passing it over a snub pulley. The pulley is generally stationary and positioned centrally with respect to the feed bobbin. Thus, while unwinding, the wire moves laterally, forming a variable angle with the pulley. In some cases, and especially for high-speed work with multiple-end wire (formed from a plurality of single wires wound together), this situation can lead to undesired crossing, overlapping and twisting, possibly resulting in breaks.

The known solution for overcoming this problem is to mount the pulley so that it can freely slide along an axis parallel to the feed bobbin. The pulley is pulled by the wire and follows the movement of the wire itself. This solution is not however entirely satisfactory, since the friction resulting from the dragging of the pulley can lead to malfunctions and breakage of the wire. It is therefore necessary to ensure a careful take-up of the wire material (often multiple strand) onto the bobbins in order to prevent kinking, winding defects, etc., which could negatively influence the subsequent manufacturing processes.

Known winding units provide take-up devices in which a strand of the wire is grasped by a gripper positioned at one end of the bobbin to be filled. Once the end of the wire is grasped, the rotation of the bobbin causes the wire to wind onto that same bobbin. However, this creates the so-called "bridge effect" problem: the section of wire extending between the gripper and the initial turns wound on the bobbin quill sticks out from the quill, as it is under tension by the flange of the bobbin. Consequently, some turns are wound onto the raised section of wire instead of directly onto the bobbin's quill, causing a bulge in the winding that can cause problems in subsequent manufacturing processes. Machines of the prior art do not offer a satisfactory solution to this problem.

SUMMARY

One of the objectives of this invention is therefore to provide a winding machine that resolves the aforementioned problems, running efficiently even at high operating speeds and preventing defects during the unwinding and winding of the bobbins.

The present invention is a winding machine having a pay-off unit for unwinding single- or multiple-end wire material from a feed bobbin and a wire guide device for guiding the unwound material from the feed bobbin to an outlet of the pay-off unit. The wire guide device has a motorized carriage which can slide along an axis of motion and bears an idler wheel on which the material unwound from the feed bobbin is wound, a sensor means to detect the slope of the material between the feed bobbin and the idler wheel, and a control unit to control the movement of the carriage as a function of the signals supplied by the sensor means. The winding machine according to the invention makes it possible for the wire material to be very efficiently unwound from the feed bobbin, preventing defects and breaks, even at high operating speeds.

According to a preferred embodiment, the present invention has at least one take-up device for wire material onto a bobbin, the take-up device comprising a gripper device for gripping a strand of the material and to hold the strand while the material is wound onto the bobbin. The machine of this embodiment further has actuator devices to reduce the gripping force of the gripper devices on the strand while the material winds onto the bobbin and holds the strand with less gripping force than the initial gripping force. This embodiment makes it possible to prevent defects in the take-up unit even in the bobbin formation phase, precluding, in particular, the onset of the so-called "bridge effect".

BRIEF DESCRIPTION OF THE DRAWINGS

Further characteristics and advantages of this invention will become obvious from the following description of a non-limiting embodiment, with reference to attached illustrated drawings, wherein.

DETAILED DESCRIPTION

Figure 1:
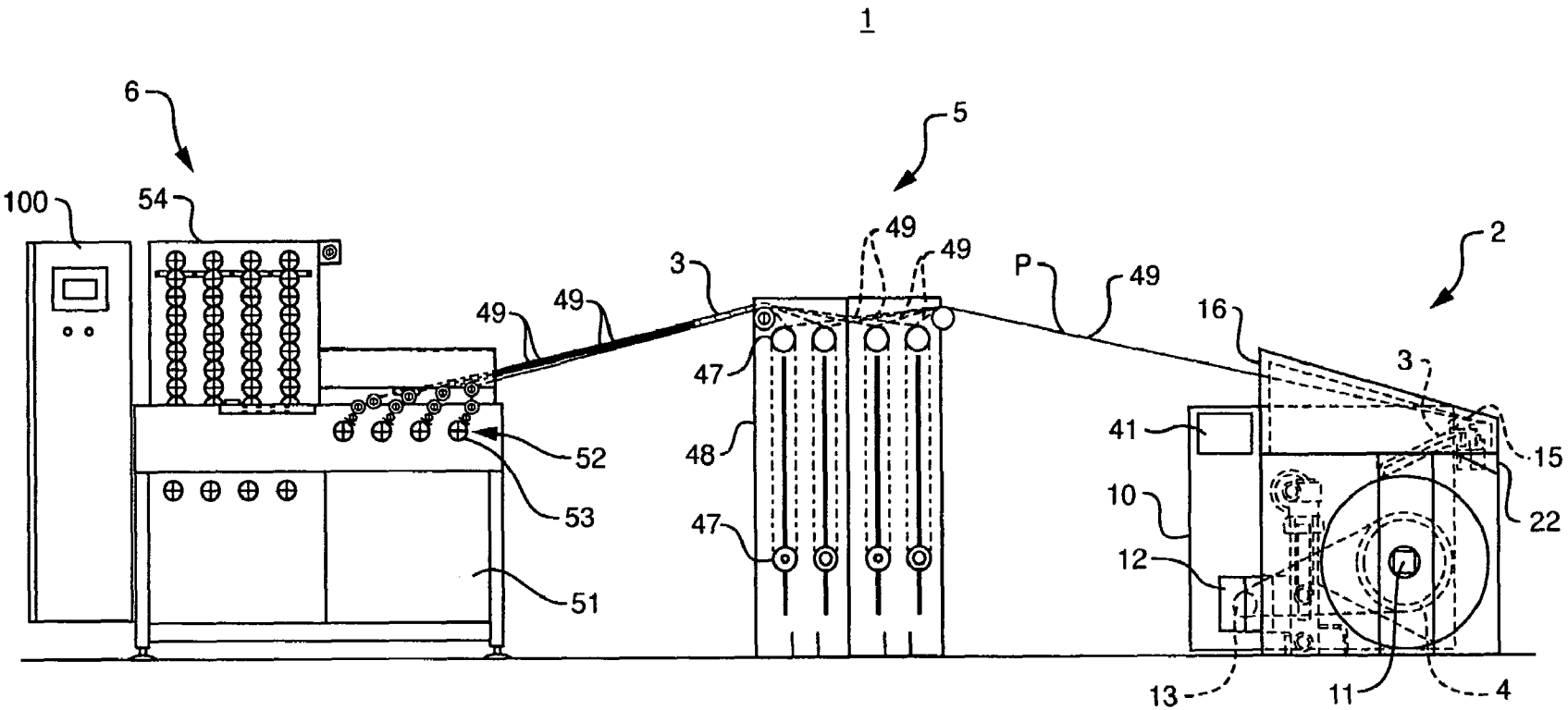
FIG. 1 is a schematic view of an embodiment of a winding machine in accordance with the present invention.

FIG. 1 shows in its entirety a winding machine 1, including a pay-off unit 2, for unwinding a single- or multiple-end wire material 3 (metallic for example, though not necessarily so) of a feed bobbin, 4, a snub and compensation unit 5, and a take-up unit 6 for rewinding material 3 onto one or more final bobbins. Pay-off unit 2, snub and compensation unit 5, and take-up unit 6 are arranged in series along a path P of material 3.

Pay-off unit 2 consists of a case 10 within which, rotating on special supports 11, feed bobbin 4 is mounted, along with a motor 12 and a transmission 13 (known) for rotating feed bobbin 4 at a controlled rate, and a wire guide device 15 for guiding material 3 unwound from feed bobbin 4 to an outlet 16 in case 10, toward snub and compensation unit 5.

Figure 2:
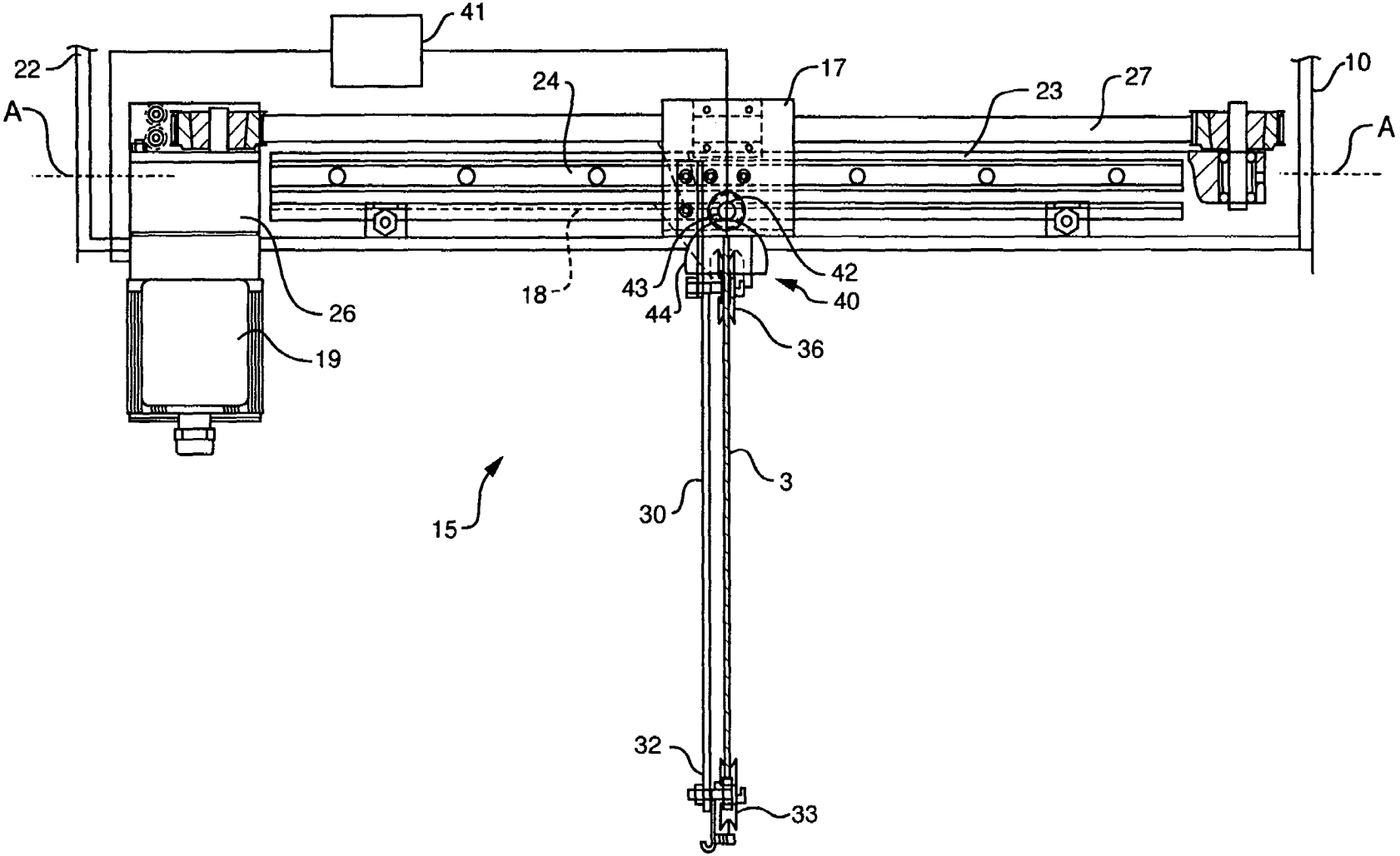
FIGS. 2 and 3 are a plan view from above and a side view, respectively, with cross sections, of an embodiment of a wire guide device included in the machine of FIG. 1.
Figure 3:
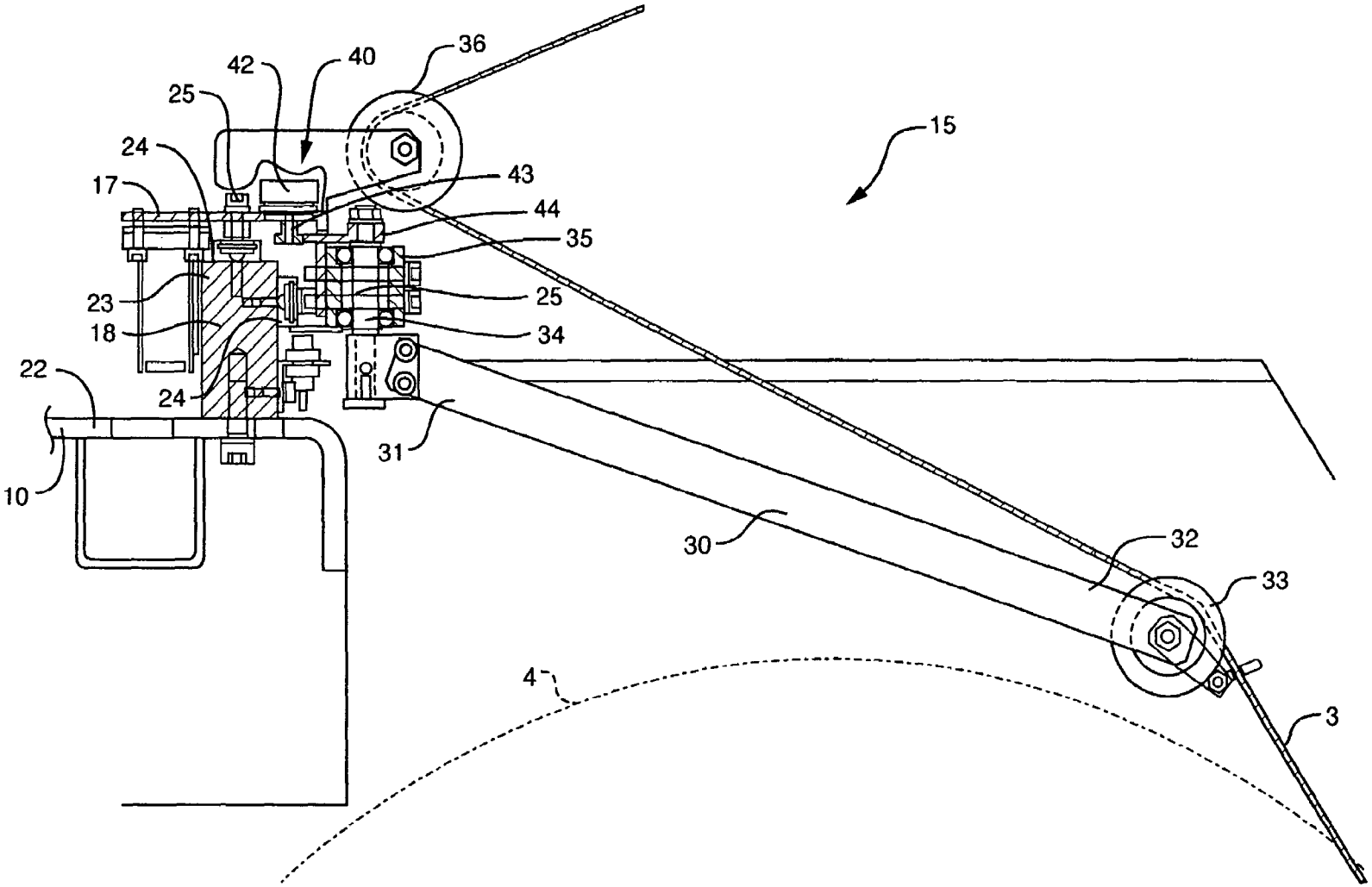

Referring to FIGS. 2 and 3 as well, wire guide device 15 includes a motorized coupled carriage 17 sliding along a guide 18 and moved by a motor 19. Guide 18 is solidly fastened to a rear rim 22 of case 10, facing feed bobbin 4, and extends along an axis A substantially parallel to a central axis of symmetry of feed bobbin 4 and delineating an axis of motion of carriage 17. Guide 18 consists of a prismatic body 23 featuring a pair of tracks 24 arranged on respective faces of body 23, orthogonal to each other, and coupled with respective sliding members 25 extending from carriage 17.

Motor 19 is built into case 10 and is connected to a reduction gear 26. Carriage 17 is connected to motor 19 and dragged along guide 18 by a positive drive belt 27, in a manner well-known in the art and thus neither described nor illustrated for the sake of simplicity.

A straight arm 30 overhangs obliquely from carriage 17 extending towards feed bobbin 4, substantially orthogonal to axis A. Arm 30 features a connecting end 31 hinged to carriage 17 and a free end 32 that supports an idler wheel 33 onto which material 3 unwound from feed bobbin 4 is wound. Arm 30 is made integral with carriage 17 and rotates with respect to carriage 17. In a preferred embodiment, arm 30 is made integral with a pin 34, which is inserted freely rotating in seat 35 supported by carriage 17 and extends substantially perpendicular to axis A, delineating an axis of rotation of arm 30 with respect to carriage 17. Carriage 17 has an auxiliary wheel 36, positioned so as to align with idler wheel 33 and mounted directly above connecting end 31 of arm 30.

Wire guide device 15 also consists of sensor means 40 for detecting the inclination of material 3 from feed bobbin 4 and idler wheel 33 and a control unit 41 for controlling the movement of carriage 17 as a function of the signals supplied by sensor means 40. In a preferred embodiment, sensor means 40 have an angular position sensor to detect the inclination of arm 30 with respect to carriage 17. For example, sensor 42 maybe a potentiometer (known) joined at connecting end 31 of arm 30 to detect the slope of arm 30 with respect to axis A. Sensor 42 is therefore supported by carriage 17 and is connected to a rotating pinion 43 mounted on carriage 17. Pinion 43 meshes with a toothed 44 disk (semicircular, for example) which is attached at an upper end of pin 34 and rotates integrally with pin 34 and thus with arm 30.

Control unit 41 (known) acts on motor 19 to govern the movement of carriage 17 along axis A so as to keep arm 30 substantially perpendicular to carriage 17 while material 3 unwinds from feed bobbin 4. The electrical connections among the various components of pay-off unit 2 are not shown for simplicity. The functional connection between control unit 41, sensor 42, and motor 19 is only illustrated schematically in FIG. 2.

Again with reference to FIG. 1, snub and compensation unit 5 is well known and is not described in detail for the sake of simplicity. In general, snub and compensation unit 5 has a plurality of pulleys 47 borne by a support 48 and onto which the respective wires or bundles of wire 49 material 3, taken-off from feed bobbin 4, are wound. The distance between pulley pairs 47 varies in order to adjust the working speed of pay-off unit 2 to the working speed of take-up unit 6.

Take-up unit 6 has a case 51 and a plurality of bobbin winding devices 52 to wind the respective wires or bundles of wires 49 of material 3 (originating from snub and compensation unit 5) onto respective bobbins 53. Bobbins 53 are drawn from a loader 54 and carried to their respective take-up devices 52 by a mobile carriage (known and not shown).

Figure 4:
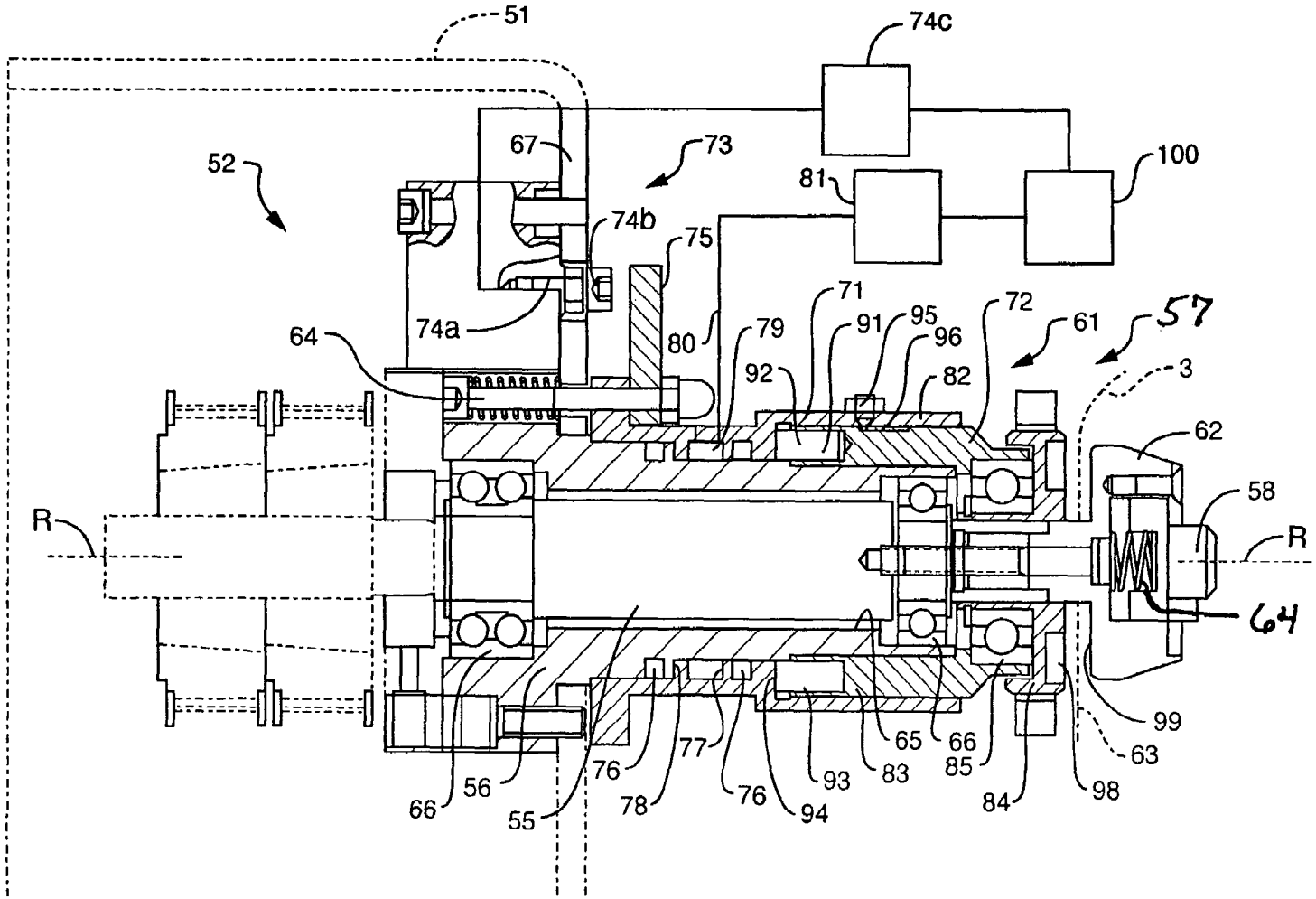
FIG. 4 is a longitudinal cross-sectional view of an embodiment of a take-up device according to the machine of FIG. 1.

As shown in FIG. 4, each take-up device 52 has a rotating spindle 55, supported around an axis of rotation R by case 51 and connected to a motor in known manner not shown, a bushing 56, fastened to case 51 and within which rotating spindle 55 is housed, and a gripper 57, positioned at a free end of bushing 56 and having a support 58 for an empty bobbin 53 to be filled.

Gripper 57 has a mobile element 61 that cooperates when closed with its counterpart member 62. Mobile element 61 and counterpart member 62 delineate the respective jaws of gripper 57 and slide one over the other along axis R to tighten an end 63 of material 3 (one wire or a bundle of wires 49) between mobile element 61 and counterpart member 62 in order to hold end 63 while material 3 is winding onto bobbin 53. At rest, mobile element 61 is kept detached from counterpart member 62 by the action of a return spring 64.

Bushing 56 is provided internally with a substantially cylindrical seat 65 in which rotating spindle 55 is housed, supported by bearings 66. Bushing 56 is fastened to a frame 67 which is in turn fastened to case 51.

Mobile element 61 is composed of two tubular telescopic components 71, 72, radially fitting one within the other, coupled together and sliding one over the other along axis R. Tubular telescoping component 71 fits radially over the outside of bushing 56 and slides along axis R with respect to bushing 56. Frame 67 bears a mechanism 73 to regulate the axial movement of telescoping component 71 with respect to bushing 56. Mechanism 73 has a small piston **74*a* that can slide in a seat formed in frame 67 and terminates with a stopper cap 74*b* and an actuator 74*c* (of any known type and shown only schematically in FIG. 4). Stopper cap 74*b* cooperates axially, abutting against flange 75 on a radius external to telescoping component 71, in order to provide telescoping component 71 with a predetermined and adjustable axial travel distance. Telescoping component 71 is coupled to bushing 56 by inserting two mutually concentric O-rings 76. Telescoping component 71 is equipped with one shoulder 77 within the internal radius, facing a shoulder 78 formed on the external lateral surface of bushing 56 to delineate an annular 79 compartment positioned between O-rings 76. Compartment 79 is connected through a conduit 80 to a pneumatic actuator 81 (known and only schematically represented in FIG. 4). Telescoping component 71 also has a cylindrical end portion 82 which houses sliding tubular telescoping component 72**.

Telescoping component 72 overhangs axially extending from telescoping component 71 and has a portion 83 that inserts sleeve-like into portion 82 of telescoping component 71 and an annular 84 head axially integrated to and rotates around portion 83 by means of bearings 85. Portion 83 is loaded by a spring actuator 91 composed of a plurality of springs 92 arranged in parallel and circumferentially along an end rim 93 of portion 83 and positioned between end rim 93 and a stop 94 within the radius formed by telescoping component 71.

Telescoping component 72 slides with respect to telescoping component 71 along the axis R from a retracted position to an extracted position. A locking screw 95, composed of a radial peg fastened to telescoping component 71 and housed in a long groove 96 formed along telescoping component 72 parallel to axis R, limits the axial travel distance of telescoping component 72 with respect to telescoping component 71 to a pre-determined value. Springs 92 tend to move telescoping component 72 away from telescoping component 71 and to keep telescoping component 72 in the extracted position.

Head 84 features a substantially planar frontal striking surface 98 that cooperates with a surface 99 of counterpart member 62. Counterpart member 62 is integrally connected to and rotates around spindle 55 and is provided with a support 58 for empty bobbin 53 to be filled which, once inserted on support 58, rotates integrally with support 58 and therefore rotates together with the counterpart member 62 and then with spindle 55.

Actuator 81 is controlled by a control unit 100 (known and only schematically shown in FIGS. 1 and 4), which also commands actuator 74*c*. Actuators 81, 91 act on gripper 57 to reduce the grasping force of gripper 57 on strand 63 while material 3 is being wound onto bobbin 53 and hold strand 63 with a lesser grasping force than the initial gripping force, bringing gripper 57 from an initial operational condition, in which gripper 57 holds strand 63 with a pre-determined gripping force, to a second operational condition, in which gripper 57 holds strand 63 with a gripping force less than the pre-determined gripping force. Actuators 81, 91 may be any suitable such device known in the art including, but not limited to, pneumatic and spring-loaded devices.

In the non-limiting embodiment referred to herein, actuators 81, 91 act on telescoping components 71 and 72, respectively, and may be activated selectively using control unit 100, to exert a primary and secondary gripping force, respectively, on strand 63. The secondary gripping force is less than the initial gripping force, has a non-zero value, and is substantially equal to the force exerted on strand 63 from the winding of material onto bobbin 53.

Machine 1 operates as follows: Feed bobbin 4 is positioned in case 10 of pay-off unit 2. One or more strands 63 of material 3 wound onto feed bobbin 4 are positioned on idler wheel 33 and on auxiliary wheel 36 of wire guide device 15. They then pass onto pulley 47 of snub and compensation unit 5 and are finally fastened onto their respective winding devices 52, being gripped with respective grippers 57.

As material 3 is unwound from feed bobbin 4, it moves in parallel to the same axis of feed bobbin 4. Arm 30 tends to follow this movement, inclining with respect to carriage 17. Sensor 42 detects the angular displacement of arm 30 with respect to carriage 17, a displacement that is also a measure of the slope of material 3 with respect to feed bobbin 4. The signal detected by sensor 42 goes to control unit 41, which governs motor 19 moving carriage 17 so as to keep arm 30 substantially perpendicular to axis A at all times.

As regards take-up unit 6, the operator places each strand 63 between member 61 and the counterpart member 62 of gripper 57. Control unit 100 (actuated by the operator) then governs the activation of pneumatic actuator 81, which acts on telescoping component 71 to securely grip telescoping component 71 against counterpart member 62 with the intervention of telescoping component 72. The emission of pressurized fluid in compartment 79 in fact causes the displacement of the entire mobile member 61 along axis R and brings gripper 57 to the operational condition in which gripper 57 holds strand 63 with a relatively high, pre-determined gripping force. Telescoping component 72 is essentially clamped against counterpart member 62 by the action of pneumatic actuator 81. Control unit 100 then activates mechanism 73, governing the advance of the small piston 74*a* driving the stopper cap 74*b* to abut against flange 75.

The take-up onto each bobbin 53 then commences. After a few turns, an initial section of the wire (or bundle of wires) 49 stretches from gripper 57 and the turns themselves. At this point, control unit 100 automatically controls the loosening of the gripping force of gripper 57. To do so, control unit 100 releases actuator 81, which then ceases to exert its action on mobile member 61. Despite the action of return spring 64, telescoping component 71 is blocked by stopper cap 74*b* cooperating with flange 75. Telescoping component 72 is no longer driven by the action of actuator 81 but is pushed by springs 92 and is therefore kept abutted against counterpart member 62 by the force of springs 92 alone. The force of springs 92 is less than the force exerted by actuator 81 and of a magnitude that allows the slipping of wire 49 in gripper 57. In this way, wire 49 flattens on the bobbin's quill 53 without causing bulging. When the whole initial section of the wire 49 is wound beneath the turns being formed, control unit 100 again activates actuator 81, restoring the initial gripping force that is maintained until the end of the winding process, and mechanism 73, retracting the small piston 74*a*.

Each of the various embodiments described above may be combined with other described embodiments in order to provide multiple features. Furthermore, while the foregoing describes a number of separate embodiments of the apparatus and method of the present invention, what has been described herein is merely illustrative of the application of the principles of the present invention. Other arrangements, methods, modifications, and substitutions by one of ordinary skill in the art are therefore also considered to be within the scope of the present invention, which is not to be limited except by the claims that follow.

The invention claimed is:

1. A winding machine comprising:

at least one take-up device for winding wire material onto a bobbin, the take-up device comprising:

at least one gripper device for gripping a strand of the material and to hold said strand while the material is wound onto the bobbin, wherein the gripper device comprises a moving member that cooperates when closed with a counterpart member to grip said strand between the moving member and the counterpart member, said moving member comprising a primary and a secondary element that are coupled and which slide over each other along an axis; and at least one actuator device to reduce the gripping force of the gripper device on said strand while the material winds onto the bobbin and holds said strand with less of a gripping force than the initial gripping force.

2. A winding machine according to claim 1, further comprising:

a pay-off unit for unwinding single- or multiple-end wire material from a feed bobbin; and a wire guide device for guiding the unwound material from the feed bobbin to an outlet of the pay-off unit, the wire guide device comprising:

a motorized carriage, which can slide along an axis of motion and bears an idler wheel on which the material unwound from the feed bobbin is wound;

sensor means to detect the slope of the material between the feed bobbin and the idler wheel; and a control unit to control the movement of the carriage as a function of the signals supplied by the sensor means.

3. A machine according to claim 2, wherein the idler wheel is mounted on an arm which is integrated to the carriage and rotates angularly with respect to the carriage, and the sensor means comprises an angular position sensor to detect the slope of the arm with respect to the carriage.

4. A machine according to claim 3, wherein the control unit governs the movement of the carriage along the axis of motion to keep the arm substantially perpendicular to the axis of motion while the wire material is being unwound from the bobbin.

5. A machine according to claim 4, wherein the arm extends cantilever-like from the carriage substantially perpendicular to the axis of motion and features a connecting end hinged to the carriage and a free end bearing the idler wheel.

6. A machine according to claim 5, wherein the sensor is a potentiometer associated with the connecting end of the arm to detect the slope of the arm with respect to the axis of motion.

7. A machine according to claim 1, wherein the actuator device acts on the gripper device to bring the gripper device from an initial operational condition, in which the gripper device holds onto said strand with a pre-determined gripping force, to a second operational condition, in which the gripper device retains the strand with a gripping force less than said pre-determined gripping force.

8. A machine according to claim 7, wherein the take-up device comprises both a primary and a secondary actuator device that may be activated selectively to exert an initial and secondary gripping force, in that order, less than the initial gripping force, on said strand.

9. A machine according to claim 8, wherein said secondary gripping force has a value other than zero and is substantially equal to the force exerted on said strand from the winding of the wire material onto the bobbin.

10. A machine according to claim 8, wherein the primary actuator device is a pneumatic actuator device and the secondary actuator device is a spring-loaded actuator device.

11. A machine according to claim 10, wherein the secondary element extends axially and cantilever-like from the primary element and features an abutting surface cooperating with the counterpart member and the primary actuator devices act on said primary element to firmly grip the primary element against the counterpart member with the intervention of the secondary element.

12. A machine according to claim 11, wherein the secondary element slides with respect to the primary element for a pre-determined travel distance between a retracted position and an extracted position and is propelled by a an elastic device located between the primary and secondary elements to keep the secondary element in said extracted position.

13. A machine according to claim 8, wherein the secondary element extends axially and cantilever-like from the primary element and features an abutting surface cooperating with the counterpart member and the primary actuator device acts on said primary element to firmly grip the primary element against the counterpart member with the intervention of the secondary element.

14. A machine according to claim 13, wherein the secondary element slides with respect to the primary element for a pre-determined travel distance between a retracted position and an extracted position and is propelled by a an elastic device located between the primary and secondary elements to keep the secondary element in said extracted position.

15. A machine according to claim 8, the primary and secondary actuator devices acting on the primary and secondary elements, respectively.

16. A machine according to one of claims 1 to 14, 11, 12, or 15, wherein the primary element is supported by a frame and can slide along said axis with respect to the frame and the take-up device comprises a mechanism to regulate said axial travel distance for the element with respect to the frame to provide the primary element with a pre-determined and adjustable axial travel distance.

17. A machine according to claim 16, wherein the actuator devices are controlled by a control unit.

18. A machine according to one of the claims 7 to 14, 11, 12, or 15, wherein the actuator devices are controlled by a control unit.

19. A machine according to claim 1, further comprising a pay-off unit for unwinding single- or multiple-end wire material from a feed bobbin.

20. A take-up device for wire material onto a bobbin comprising:

gripper devices to grip a strand of the wire material and to hold the strand during the winding of the material onto the bobbin, wherein the gripper devices comprise:

a moving member, the moving member comprising a primary and a secondary element that are coupled and which slide over each other along an axis; and a counterpart member, the moving member cooperating with the counterpart member to grip said strand between the moving member and the counterpart member; and actuator devices to reduce the gripping force of the gripper devices on said strand during the winding of the material onto the bobbin and to hold said strand with a lesser gripping force than the initial gripping force.

* * * * *